US007730678B2

(12) United States Patent
Czapka

(10) Patent No.: US 7,730,678 B2
(45) Date of Patent: Jun. 8, 2010

(54) GLASS COMPOSITE

(76) Inventor: Linda Czapka, Heiligenstaedter Strasse 145/15/10, Wien (AT) A-1010

( * ) Notice: Subject to any disclaimer, the term of this patent is extended or adjusted under 35 U.S.C. 154(b) by 1325 days.

(21) Appl. No.: 10/497,940

(22) PCT Filed: Dec. 6, 2002

(86) PCT No.: PCT/AT02/00344

§ 371 (c)(1),
(2), (4) Date: Sep. 24, 2004

(87) PCT Pub. No.: WO03/048494

PCT Pub. Date: Jun. 12, 2003

(65) Prior Publication Data

US 2005/0028461 A1 Feb. 10, 2005

(30) Foreign Application Priority Data

Dec. 7, 2001 (AT) ..... A 1925/2001

(51) Int. Cl.
*E06B 3/66* (2006.01)
*E06B 3/663* (2006.01)

(52) U.S. Cl. ..... 52/204.593; 52/204.595; 52/204.6; 52/786.13; 52/786.1; 428/34

(58) Field of Classification Search ..... 52/204.6, 52/204.593, 204.595, 504.597, 786.1, 786.11, 52/793.1, 4.597, 455, 457, 786.13, 204.599; 428/34
See application file for complete search history.

(56) References Cited

U.S. PATENT DOCUMENTS 2,430,873 A * 11/1947 Haas ..... 52/208
2,772,496 A * 12/1956 Meyrick et al. ..... 40/545
2,834,999 A * 5/1958 Taylor et al. ..... 52/172
3,226,903 A * 1/1966 Lillethun ..... 52/172
3,462,899 A * 8/1969 Sherman ..... 52/309.6
3,512,320 A * 5/1970 Choquette et al. ..... 52/172
3,790,748 A * 2/1974 Van Laethem et al. ..... 219/219
4,128,448 A * 12/1978 Bitterice et al. ..... 156/166
4,149,348 A * 4/1979 Pyzewski ..... 52/172
4,975,307 A 12/1990 Sollogoub
5,007,217 A * 4/1991 Glover et al. ..... 52/172
5,205,884 A 4/1993 Rauscher
5,333,428 A * 8/1994 Taylor et al. ..... 52/308
RE35,120 E * 12/1995 Heaney ..... 312/116
5,601,677 A * 2/1997 Leopold ..... 156/109
5,834,124 A * 11/1998 Pease et al. ..... 428/430
5,884,441 A * 3/1999 Monroe et al. ..... 52/204.59
6,185,882 B1 * 2/2001 Pearson ..... 52/204.5
6,185,883 B1 2/2001 Howard (Continued)

FOREIGN PATENT DOCUMENTS

BE 1012746 A 3/2001

(Continued)

*Primary Examiner*—Phi D. A
(74) *Attorney, Agent, or Firm*—Townsend and Townsend and Crew, LLP

(57) ABSTRACT

A glass compound is provided with two or several glass plates 1, 2 spaced apart A by a spacer 4, wherein between adjacent glass plates 1, 2 at least one inherently rigid plate element 3 is inserted whose thickness D is dimensioned to be smaller than the distance A between adjacent glass plates 1, 2 of the glass compound.

16 Claims, 3 Drawing Sheets

U.S. PATENT DOCUMENTS

| | | | | |
|---|---|---|---|---|
| 6,266,940 | B1 * | 7/2001 | Reichert | 52/786.13 |
| 6,640,510 | B2 * | 11/2003 | Kane | 52/204.59 |
| 6,817,146 | B2 * | 11/2004 | Jasperson | 52/204.59 |
| 7,114,353 | B1 * | 10/2006 | Charlton et al. | 65/107 |

FOREIGN PATENT DOCUMENTS

| | | | |
|---|---|---|---|
| CA | 861839 | A | 1/1971 |
| DE | 2707398 | A1 | 3/1977 |
| EP | 0324710 | A1 | 7/1989 |
| EP | 0721086 | A1 | 7/1996 |
| FR | 2606861 | A1 | 5/1988 |

* cited by examiner

GLASS COMPOSITE

BACKGROUND OF THE INVENTION

The invention relates to a glass compound, in particular for use as a window, door or architectural element, especially for ornamental purposes or as a sunscreen, comprising two or several glass plates spaced apart by a spacer, wherein between adjacent glass plates an inherently rigid plate element is loosely inserted whose thickness is dimensioned to be smaller than the distance between adjacent glass plates of the glass compound.

A glass compound of this kind is known, for instance, from EP-A1 0 324 710 and EP-A2 0 078 530. According to the former document, intermediate panes are arranged between adjacent glass plates, which panes are mounted to the outer edge of the glass compound by means of support pins; the latter document relates to a noise-protection glazing comprising a middle pane that has an undivided surface and extends across the entire surface of the glass compound.

Such known glass compounds do not allow any particular optical design of the middle pane, unless very high expenses are involved.

From GB-A 1 426 551, a glass compound is known that has a middle pane which is configured as a lead glazing in order to provide possibilities of optical design.

According to U.S. Pat. No. 6,138,433, a decorative element, which is translucent but forms one piece, is inserted in a double-pane glass compound.

DE-A1 42 26 883 shows that a glass compound comprising more than two glass plates spaced apart by a spacer is known.

From U.S. Pat. No. 4,975,307 A, a glass compound is known according to which an inherently rigid plate element is provided between adjacent glass plates, which plate element is configured so as to be multipart, with the parts lying on one plane, directly abutting each other with their peripheral rims, yet being glued to the glass plates.

DE 27 07 398 A shows a plate element between two glass panes, which, however, is configured as one piece. As a result of the large distance between the glass panes, the plate element inserted between them is supported relative to each glass pane by means of resilient supports, whereby the resilient supports are provided in the rim areas of the plate element, namely in the areas that are oriented in parallel to the glass panes.

EP 0 721 086 A relates to a disk lamp composed of two glass panes with an optical-fiber plate inserted therebetween. Above at least one edge of the optical-fiber plate, a cavity for receiving a light source is provided.

SUMMARY OF THE INVENTION

An object of the present invention is to provide a glass compound of the initially described kind involving a possibility of optical design that can easily be technically realized, wherein almost no limits are set in particular to artistic creativity.

With a glass compound of the initially described kind, the object is achieved in that several in-plane plate elements are inserted between two adjacent glass plates, the total surface of the elements preferably roughly corresponding to the total surface of the glass compound, with adjacent plate elements directly abutting each other with their peripheral rims, and in that the thickness of the plate elements, according to the possible thermal expansions of the elements, is dimensioned to be smaller than the distance between adjacent glass plates.

If the glass compound is exposed to fluctuations of temperature, such as, for instance, when being used as a window or door element, the plate element is suitably supported at the edge on the glass compound by a resilient support element.

The thickness of the plate element is dimensioned to be smaller than the distance between adjacent glass plates of the glass compound, according to the possible thermal expansions of the element, so as to avoid the occurrence of interference phenomena even in case of quite large fluctuations of temperature.

A particularly decorative design of the glass compound is characterized in that the plate element is transparent, in particular colorless or colored, whereby the plate element advantageously is manufactured from a synthetic material, in particular as an acrylic glass plate.

It has turned out to be advantageous that the plate element is supported at the edge on the spacer by a resilient support element and that—in particular if several plate elements are arranged—it surrounds those elements in the assembled state. Advantageously, a plate comprised of several plate elements can be used, which then is supported at the edge on the spacer by a resilient support element.

The resilient support element is preferably made of silicone and is suitably configured as a silicone tube, wherein, if the position of the glass compound deviates from a horizontal position, the resilient support element advantageously is shaped in the rim area of the plate element, which rim area serves as a base, in order to receive forces that are larger than in other rim areas surrounding the plate element. Such a formation is particularly suitable for the vertical arrangement of a glass compound.

For window and door elements, the glass compound is suitably characterized in that adjacent glass plates are arranged at a distance of 6 to 12 mm, preferably 8 to 10 mm.

Advantageously, the distance between adjacent glass plates is dimensioned to be larger by 2% to 45%, preferably by 10% to 20%, than the thickness of a plate element. Therefore, the plate elements are inserted loosely between the glass plates.

Advantageously, the edges of adjacent plate elements positively interlock on one level in order to secure the position of adjacent plate elements.

A technically particularly simple construction is characterized in that the spacer and the resilient support element are configured as a building unit.

A particularly attractive embodiment is characterized in that a light source is attached to the edge of at least one plate element, the light source advantageously being inserted in a recess of a plate element.

The light is introduced to the plate element particularly well if the light source is in direct contact with the plate element, whereby the direction of radiation of the light source advantageously is oriented in the direction of the plane of a plate element.

A light-emitting diode and/or a laser diode preferably serves as the source of light. In the following, the invention is illustrated in further detail with respect to the drawing.

DESCRIPTION OF THE PREFERRED EMBODIMENTS

Figure 2:
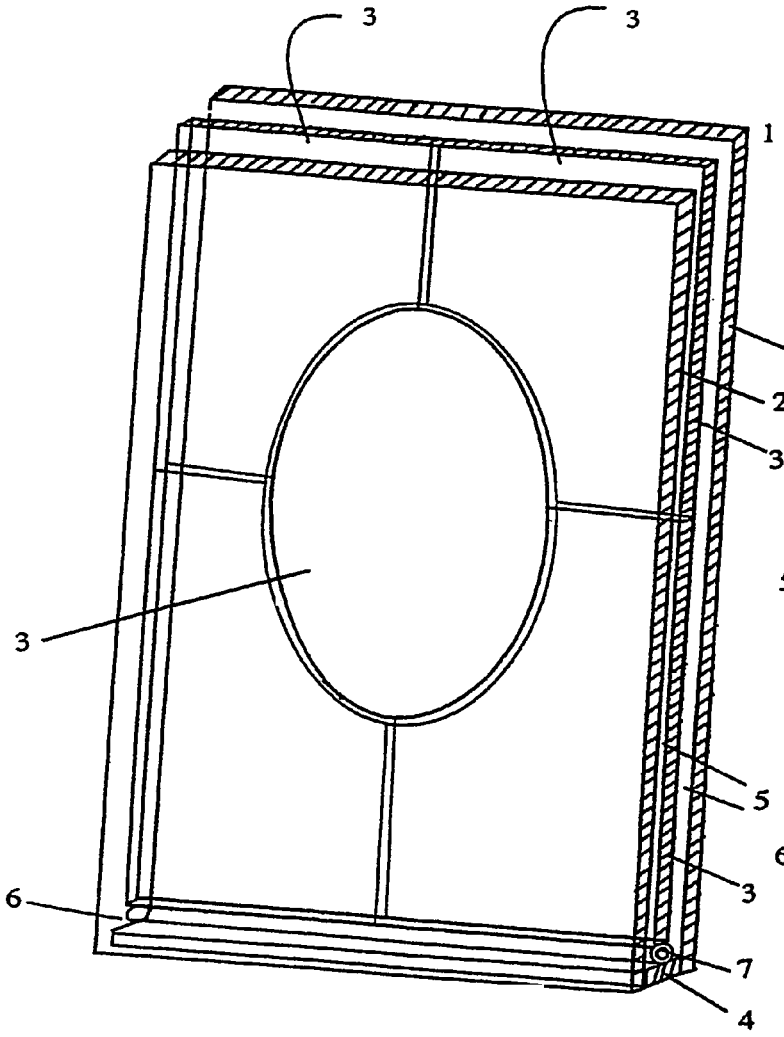
FIG. 2 shows a cutout from such a glass compound in the diagonal section.
Figure 1:
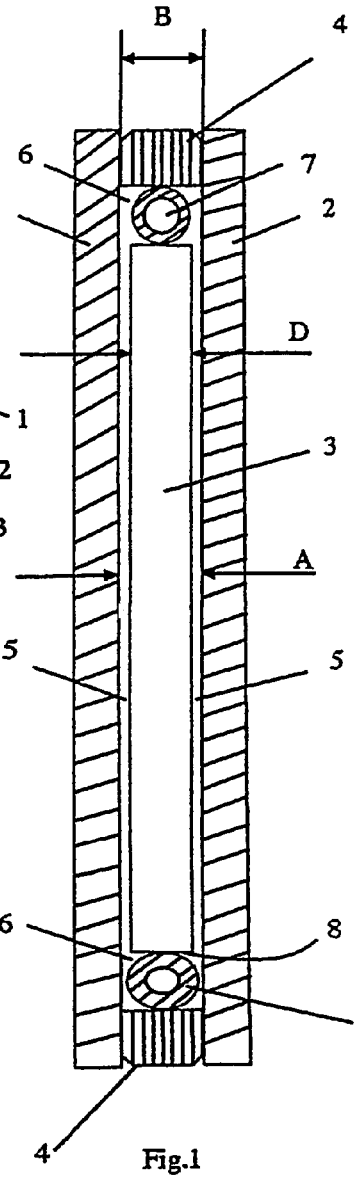
FIG. 1 shows a cross-section through a glass compound of the type according to the invention.

A plate element 3 such as an acrylic glass plate 3 of approximately 6 mm (or 7 mm or 8 mm)—or a plate element made of another synthetic material—is placed between two glass plates 1, 2 of a glass compound that are spaced apart at a distance A and are combined by a spacer 4 having a width B of 8 mm (or 10 mm). The colored transparent or colorless acrylic glass plate 3 (for instance, PMMA polymethylmethacrylate), which was cut by laser, may thus be used in the glass compound as a shaped and colored window, door or architectural element, for instance as a furniture element or a sightscreen element, whereby it can assume the function of a sunscreen due to its material property (filtering ultraviolet light). In the illustrated exemplary embodiment, several plate elements 3, i.e. several acrylic glass plates 3, are assembled in a unit.

If an arbitrary number of acrylic glass plates 3 is configured as a unit, the elements are assembled like in a puzzle so as to form a complete plate comprised of several plate elements 3, which plate remains whole without adhesive sealing due to the selected narrow distances to the glass plates 1, 2 and cannot get displaced even during transport. Geometrical shapes and graphic characters but also any other kind of image which can be realized by the method (the abutting edges of the varicolored elements form the preliminary drawing) appear to be particularly suitable for designs.

A multipart acrylic plate 3 is coated, only for the assembly, on both sides with a detachable protective film which is peeled off during assembly so that, with ease, the plate can as a whole be integrated in the glass compound.

In order to take into account the thermally induced expansion of the material of the plate element 3 and to avoid the occurrence of interference phenomena, respectively, a clearance 5 between the acrylic glass plate 3 and the glass plates 1 and 2, preferably of at least 1-2 mm in each case (up to 2 mm in each case, if the acrylic glass has a material thickness of 8 mm) must be observed, which clearance is dimensioned depending on the thickness D of the plate element 3 or of the acrylic glass plate 3, respectively, as well as on the maximum thermal expansions to be expected. At the lateral edges of the glass compound, a clearance 6 corresponding to the size of the acrylic glass plate 3 is to be chosen, also because of the thermally induced expansion. The clearance is balanced by silicone tubes 7 (diameter 5-8 mm) inserted along the lateral rims, which slacken upon the expansion of the acrylic glass plate 3 and, at the same time, support the structure of a multipart acrylic glass plate 3 as a whole. In doing so, a stronger silicone tube 7 (diameter 6-9 mm) must be used at the lower lateral edge 8 because of the weight of the acrylic glass plate 3.

Figure 3:
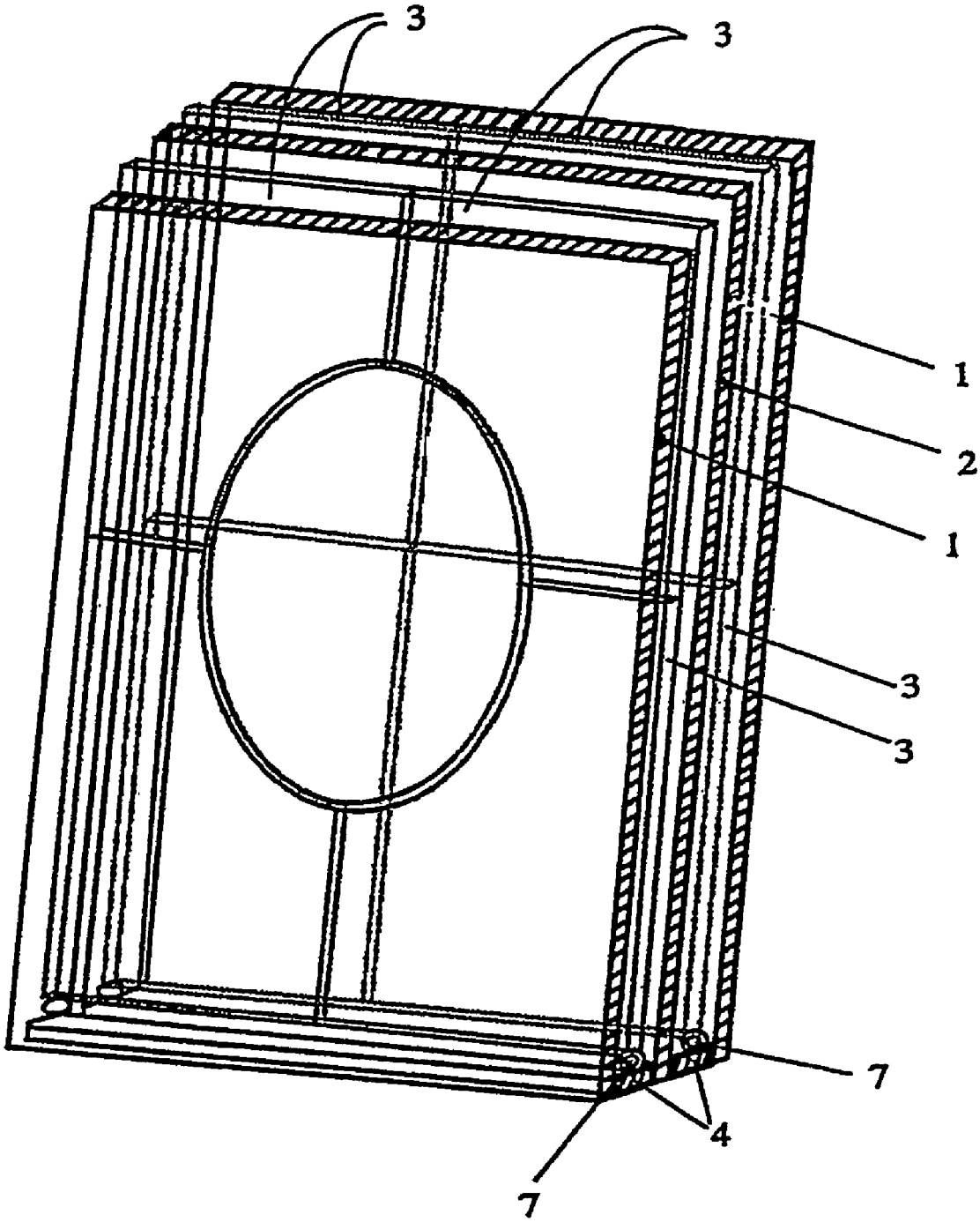
FIG. 3 shows the formation of a glass compound composed of three glass plates in analogy to FIG. 2.

In the glass compound which, also for reasons of, for instance, fire protection or heat insulation, may also consist of several glass panes—see FIG. 3—, acrylic glass is characterized by a small dead weight, the possibility of exact processing in complex designs and stability with respect to transport, jolting, etc.

Metal springs, plastic clips or glass elements may also serve as spacers 4 between the adjacent glass plates 1, 2.

As material for a plate element 3, not only synthetic materials such as acrylic glass come into consideration, although they have proven to be of particular value, but also wood, metal or mineral materials such as marble, semi-precious stones, etc. can likewise be used. A plate element 3 may also be provided with holes. No limits are set to the freedom of creative expression.

For particular applications, such as, for instance, when being used as a table top, the glass compound can even go without any resilient support elements 7 at the edge. This is the case, in particular, if no or almost no fluctuations of temperature are to be expected for the glass compound.

The glass compound according to the invention can also be used as a noise-protection element.

According to the glass compound illustrated in FIG. 3, three glass panes 1, 2 arranged in parallel to each other are provided, and one plate element 3 at a time, in the illustrated exemplary embodiment several plate elements 3 at a time, are inserted between the first 1 and the middle glass panes 2 as well as between the middle 2 and the last glass panes 1.

Figure 4:
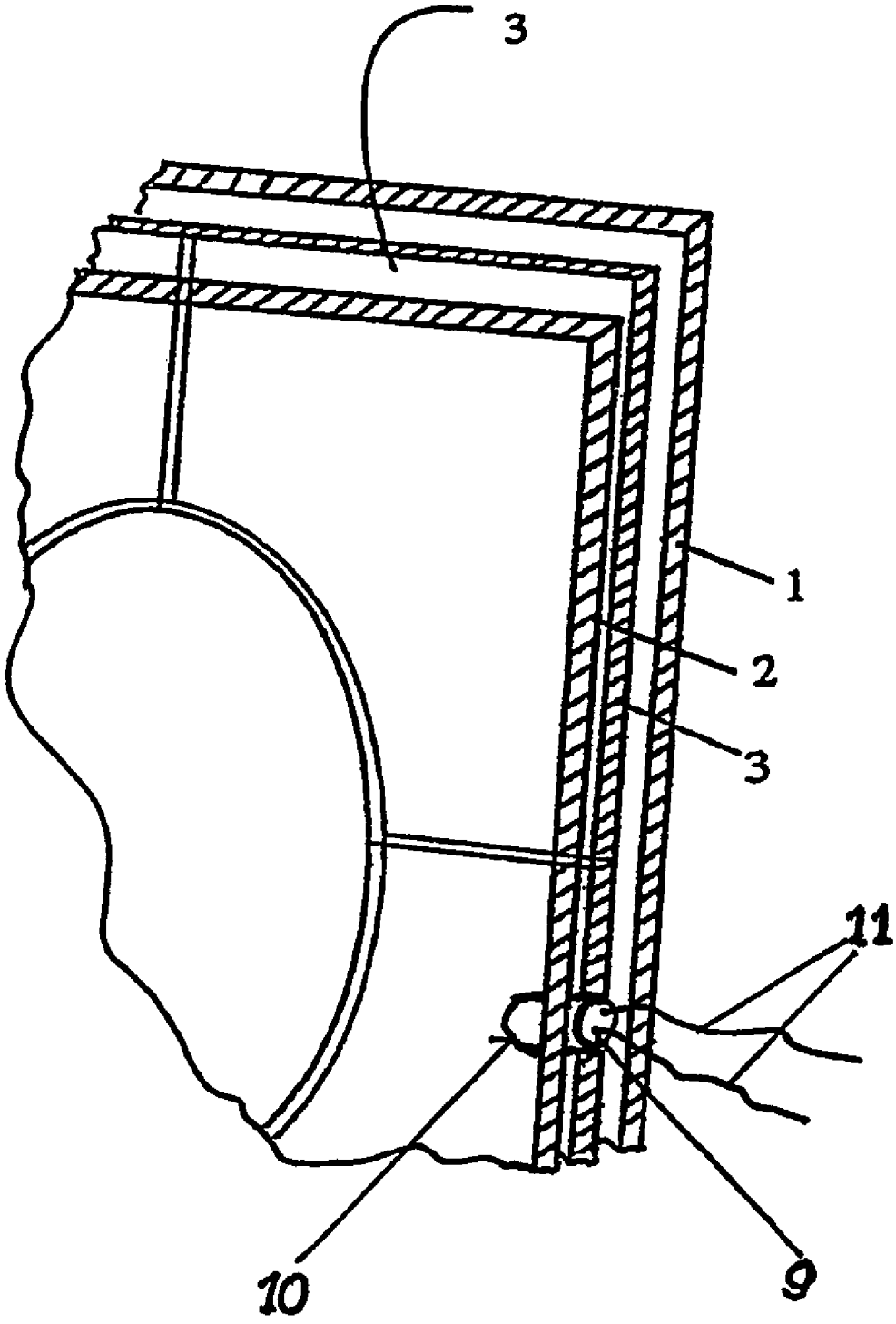
FIG. 4 shows an embodiment of the glass compound that has a light source in an illustration analogous to FIG. 2.

According to the embodiment illustrated in FIG. 4, a glass compound is equipped with a light source 9. The light source is inserted in a recess 10 of at least one plate element 3, wherein the orientation of the light source 9 is chosen such that the main direction of radiation of the light source is oriented in the direction of the plane of the plate element 3. Current-supply wires 11 are led outward either through the spacers 4 or between the spacer and the glass plates 1, 2, whereby the impermeability of the glass compound is maintained.

The light fed into a plate element 3 is reflected on the surfaces of the element, and scattering or emission, respectively, occurs only at the peripheral rim of a plate element 3, which might lead to particularly attractive edge effects. The type of the surface condition of the plate element 3 also allows for a partial emission of light and hence the creation of a light effect on a surface, for instance, if the surface is roughened. By means of a reflection lacquer, a total reflection of light can be achieved.

For the light supply to the plate element 3, it is important that the light source 9, in the illustrated exemplary embodiment a light-emitting diode, is directly attached to the plate element 3, preferably without clearance, i.e. involving a direct contact and in a manner that is as dust-free as possible, so that scatterings during the supply of light are avoided if at all possible.

The invention claimed is:

1. A glass compound comprising a plurality of outer glass panes, a spacer arranged proximate edges of the glass panes which maintains the panes at a predetermined spacing from each other, a panel disposed in the spacing between the panes, the panel having panel surfaces, a transverse peripheral rim surface between the panel surfaces and a thickness which is less than the spacing between the glass panes, the spacing being free of any member or members that together simultaneously contact opposing surfaces of the panes and the panel, the panel having a total surface area which roughly corresponds to but is less than a total surface area of the spacing parallel to the glass panes, the panel being dimensioned and configured so that the peripheral rim surface is spaced from and out of contact with the spacer between the outer glass panes, whereby the panel is loosely arranged between the glass panes and the spacer, and a resilient member disposed between the peripheral rim surface and the spacer and capable of engaging only the peripheral rim surface of the panel for keeping the peripheral rim surface spaced apart from the spacer, the resilient member extending over at least a portion of the length of the peripheral rim surface.

2. A glass compound according to claim 1 wherein at least one of the panel sections of a plate element is transparent, colorless or colored.

3. A glass compound according to claim 1, wherein the panel is manufactured from a synthetic material.

4. A glass compound according to claim 1, wherein the resilient member is made of silicone.

5. A glass compound according to claim 1, including a light source attached to an edge of at least one panel section.

6. A glass compound according to claim 5, wherein the light source is inserted in a recess at the edge of the at least one panel section.

7. A glass compound according to claim 5, wherein the light source is in direct contact with the at least one panel section.

8. A glass compound according to claim 5, wherein a direction of radiation emitted by the light source is oriented in the direction in which the at least one panel section extends.

9. A glass compound according to claim 5, wherein a light-emitting diode and/or a laser diode is provided as the source of light.

10. A glass compound according to claim 3, wherein at least one panel section is an acrylic glass plate.

11. A glass compound according to claim 1 wherein the resilient member is a tubular member.

12. A glass compound according to claim 1 wherein the spacing between the glass plates is between 2% and 45% larger than the thickness of the panel.

13. A glass compound according to claim 12, wherein the spacing between the glass plates is dimensioned to be larger by 10% to 20% than the thickness of the panel.

14. A glass compound according to claim 1 wherein the panel comprises a plurality of independent panel sections which are irregularly shaped.

15. A glass compound according to claim 1 wherein the edges of the panel sections are not adhesively connected to each other.

16. A glass compound according to claim 14 wherein at least one of the panel sections is transparent.

* * * * *